United States Patent [19]

Jennings

[11] 4,051,814

[45] Oct. 4, 1977

[54] HIGH PRESSURE WASHER

[75] Inventor: William S. Jennings, West Covina, Calif.

[73] Assignee: Clayton Manufacturing Company, El Monte, Calif.

[21] Appl. No.: 680,966

[22] Filed: Apr. 27, 1976

[51] Int. Cl.[2] ..... F22D 5/00; F23N 1/08

[52] U.S. Cl. ..... 122/448 R; 122/448 B; 122/451 R

[58] Field of Search ..... 122/4, 448 R, 448 A, 122/448 S, 451 R, 451 S

[56] References Cited

U.S. PATENT DOCUMENTS

| | | | |
|---|---|---|---|
| 2,062,925 | 12/1936 | Ofeldt | 122/448 |
| 3,485,176 | 12/1969 | Telford et al. | 122/448 |

*Primary Examiner*—Kenneth W. Sprague
*Attorney, Agent, or Firm*—Jackson & Jones Law Corporation

[57] ABSTRACT

A pressurized hot fluid washer includes a combination pumping unit driven by a closed hydraulic system which applies driving impulse forces to an interlocked liquid pump member and a fuel pump member. The liquid pump and fuel pump are hydraulically interlocked so that when liquid is not being discharged through the cleaning gun, the fuel will definitely be stopped. A static pressure line senses the pressure downstream of the liquid pump and transmits the pressure to one end of a spring biased by-pass spool valve. At a predetermined liquid pressure, the spool valve will sequentially close a hydraulic conduit first to deactivate the fuel pump and then open a by-pass conduit to deactivate the liquid pump member. Thus, both the fuel pump and the liquid pump will be automatically stopped, for example, when the cleaning gun is not being used. In addition, a differential area piston is provided in the hydraulic system between the by-pass spool valve and the fuel pump. The differential area piston reduces the high pressure required of the water supply to a more suitable pressure for the fuel pump.

10 Claims, 2 Drawing Figures

HIGH PRESSURE WASHER

BACKGROUND OF THE INVENTION

1. Field of the Invention

The present invention is directed to an improvement in a hot fluid washer apparatus and more particularly to an improved hydraulic interlocked water and fuel pumping system.

2. Description of the Prior Art

High pressure washers that deliver either hot water or steam are well known in the prior art. Generally, a pressurized hot fluid washer will include a solution of water and a cleaning compound that is heated under pressure as it flows through a heat exchange coil. These devices are frequently used in small machine shops, garages, brake and front end specialty shops, hospitals, farms, ect. A prime example of the prior art can be found in the Arant U.S. Pat. No. 3,261,330 assigned to the assignee of the present invention. In that washer, a multi-chamber diaphragm pump received pulses imparted to the diaphragm through a prime mover to effect pumping of the cleaning solution into the heating coil and also to effect the pumping of the fuel to the burner. Another example of a prior art hot water washing apparatus is described in the Telford et al. U.S. Pat. No. 3,485,176.

Although the prior art has provided commercially successful high pressure washers, there is still a need to provide a relatively economical and safe interlock system which is compatible with the pumping forces required for a liquid pump and also for pumping fuel.

SUMMARY OF THE INVENTION

The present invention is directed to an improved pressurized hot fluid washer apparatus that includes a combination liquid and fuel pumping system. The pressurized hot fluid washer includes an output conduit that is connected to a nozzle gun for applying the hot fluid. The cleaning gun has an operator controlled delivery valve. The output conduit is connected to a heat exchanger such as a coil conduit for the heating of the fluid. An appropriate fuel burner which can utilize kerosene, gasoline (where code requirements permit) or mineral spirits is connected to the combustion chamber of the heat exchanger.

The liquid and fuel pump system is a combination water, fuel and cleaning solution pumping unit. The pump system also includes a liquid-fuel interlock safety feature which automatically stops the fuel delivery if liquid delivery fails or is stopped. The hydraulic pumping system is composed of a double ended reciprocal piston operating submerged in hydraulic oil to produce driving impulse forces. Communicating with each end of the piston are flexible diaphragms which separate the hydraulic oil from the liquid and translate the displacement of the piston through the diaphragm to pump the liquid. Appropriate check valves are utilized to control the directional flow of the liquid. The fuel pump is further operated with the same hydraulic impulse force which drives one of the liquid diaphragm pumps. A dual diameter or differential area piston in a hydraulic impulse line of the fuel pump reduces the high pressure of the liquid side to a more suitable pressure for the fuel side.

The fuel and liquid shut-off control includes a spool valve that is actuated by a piston. One end of the piston is connected to a static pressure line on the output side of the liquid pump. On rise of liquid pressure above normal flow conditions, the spool valve will move to close off the pressure hydraulic impulse line to the fuel pump thereby stopping the fuel delivery and extinquishing the burner flame. Any further pressure increase will cause the spool valve to open by-pass ports in each cylinder and stop the hydraulic action on each liquid diaphragm. When the static liquid pressure drops, for example, by opening the liquid delivery control valve, the spool valve returns to its normal operating position and the liquid and fuel pumps can resume their operation. This positioning of the lands on the spool valve insures that a leak in the liquid system will not reactivate the fuel pumping.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE PREFERRED EMBODIMENT

The following description is provided to enable any person skilled in the high pressure washer art to make and use the invention and sets forth the best mode contemplated by the inventor of carrying out his invention. Various modifications, however, will remain readily apparent to those skilled in the art since the generic principles of the present invention have been defined herein specifically to provide a high pressure washer system that can be manufactured in a relatively economical manner.

Figure 1:
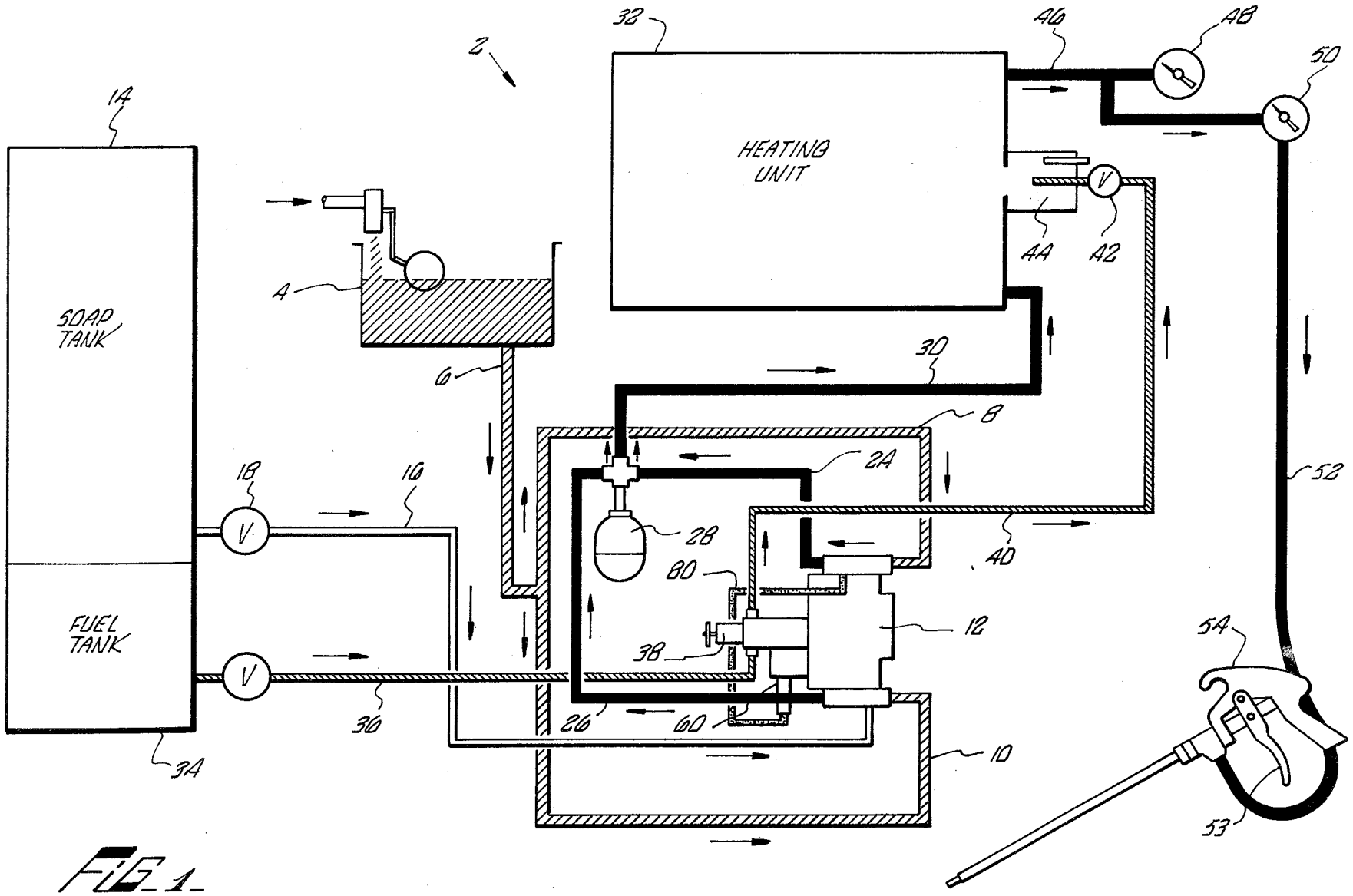
FIG. 1 is a schematic flow diagram of the high pressure washer apparatus.

Referring to FIG. 1, the high pressure washer apparatus 2 of the present invention is disclosed in a schematic view. Water can be introduced by gravity flow into the washer apparatus 2 from a float tank 4 through a bifurcated water line 6. Both branches 8 and 10 of the water line 6 are attached to a dual diaphragm water pump 12. A diaphragm pump is advantageous in that it prevents corrosion and sealing problems by separating the water from the pumping pistons. Generally, disc type stainless steel check valves can be used on the water side of the water pump.

A soap tank 14 is connected to a soap concentrate line 16 through a soap tank valve 18. A metered amount of soap concentrate can be introduced through a control valve into the water intake line 10. A restriction in the water intake line 10 creates sufficient vacuum to draw the concentrate into the water line 10.

In the preferred embodiment, the water pump 12 includes a pair of flexible diaphragms that are driven by a double ended reciprocating piston operating submerged in hydraulic oil. A portion of the piston 20 and a schematic of one flexible diaphragm 22 can be seen in FIG. 2. As can be appreciated by a person skilled in the art any number of pumping diaphragms can be radially mounted about the pump housing. Water discharge lines 24 and 26 are attached to a snubber 28 which acts as a shock absorbing means for absorbing the pump pulsations and delivering solution to the heating coil in a smooth flowing continuous stream. The discharge line 30 is connected directly to the heat exchange heating unit 32.

The heating unit 32 can comprise a continuous single steel tube, spirally wound, to provide counterflow of liquid solution across the heating or combustion chamber. While not shown, radiant heat from the combustion chamber can be controlled by a heavy layer of insulation about the heating coil. The heating coil is mounted to allow free expansion and is designed for easy access.

A fuel tank 34 is connected to delivery fuel through a fuel line 36 to the fuel pump 38. The fuel pump 38 is connected to a discharge line 40 which is connected first to an automatic fuel shut-off valve 42 and then to the burner assembly 44. The burner assembly can be a forced draft burner with a blower unit (not shown) and an atomizing fuel nozzle. A high potential electrical spark can provide automatic burner ignition. The automatic fuel shut-off valve 42 is basically a spring biased diaphragm back pressure valve that will close when the fuel pressure is below 70 psi and will open when the fuel pressure rises to 90 psi. The shut-off valve 42 insures that the fuel will only be delivered to the nozzle under sufficient pressure to atomize the fuel in the burner 44.

The liquid, which can be a solution of water and soap concentrate, is appropriately heated in the heat exchanger 32 and is discharged through an output conduit 46. A discharge pressure gauge 48 and a temperature gauge 50 appropriately monitor the heated liquid. A flexible hose 52 can be connected to a cleaning gun 54.

Figure 2:
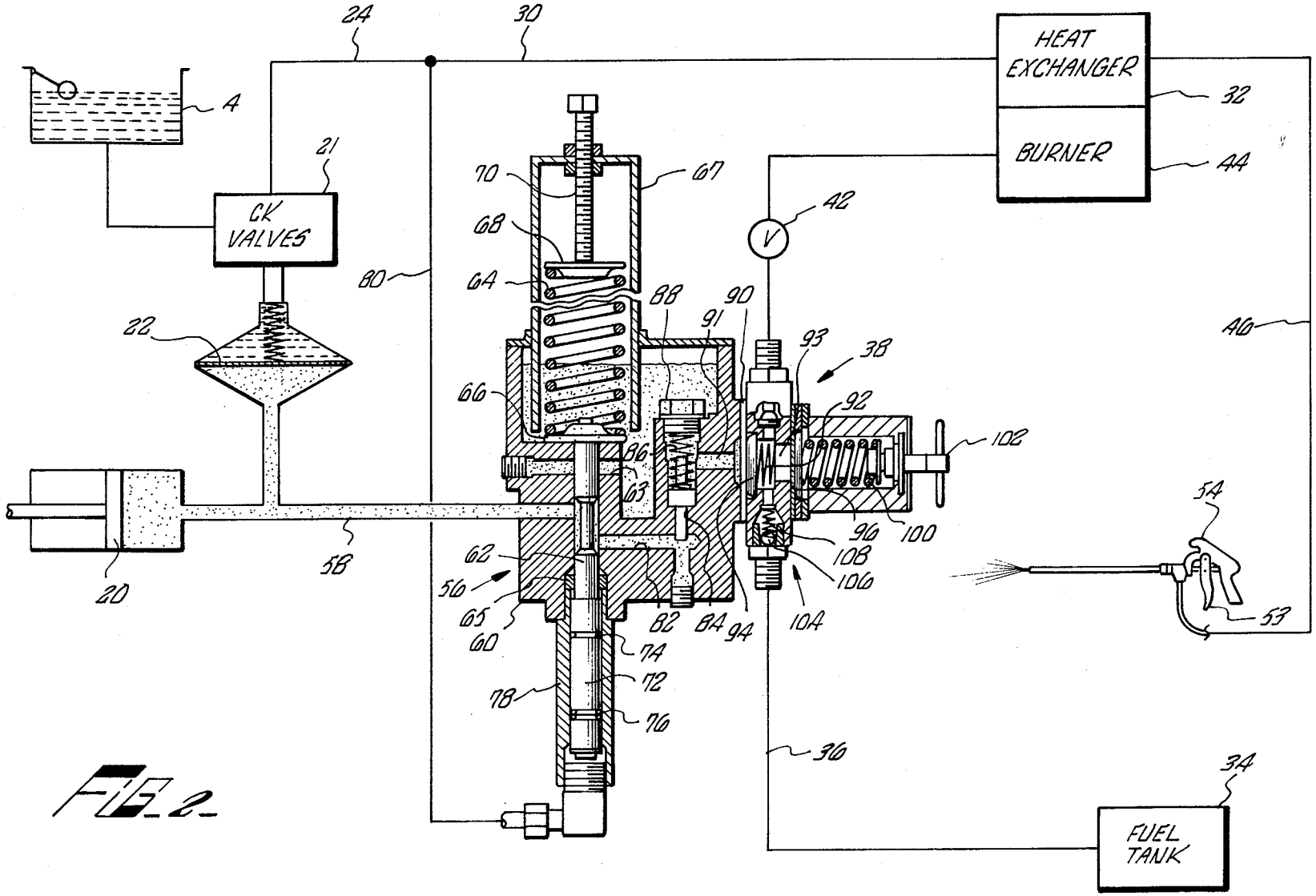
FIG. 2 is a schematic cross-sectional view of the liquid and fuel control and interlock system.

Referring to FIG. 2, a simplified schematic view of the interlocked liquid and fuel system is disclosed. A portion of the hydraulic pump piston 20 is disclosed hydraulically connected to one liquid pump diaphragm 22 and also connected to an actuator by-pass assembly 60 through a hudraulic line 58.

The diaphragm 22 is spring biased and segregates the pumped liquid from the hydraulic pumping system. Appropriate check valves 21 control the directional liquid pumping flow.

Mounted within the actuator by-pass assembly 60 is a spool valve 62. A by-pass return spring 64 is secured within spring housing 67 at one end by a retainer ring for attachment to a spring washer 66. Another spring washer 68 seats a set screw 70 which is capable of varying the spring bias against the spool valve 62.

At the other end of the spool valve 62, an actuator piston 72 is mounted capable of exerting a vertical force against spool valve 62 and the spring 64. Appropriate O-ring packings 74 and 76 seal the actuator piston 72 relative to the actuator cylinder 78. The spool valve 62 can be sealed from abrasive dirt particles by a felt washer 65. A static pressure line 80 is connected to the liquid discharge line 24 to provide a hydraulic sensing of the liquid pressure downstream of the liquid pump member.

The fuel hydraulic pressure line 82 is connected to the fuel pump 38 through a differential area piston 84. A piston return spring 86 is mounted against a stop cap 88 which seals the actuating chamber side of the fuel pump diaphragm 90.

The differential area piston 84 converts the high pressure force impulses which drive the liquid pump diaphragm into reduced, e.g., 4 to 1 ratio, force impulses to drive the fuel pump 38. This feature of the present invention permits the use of a more economical fuel pump assembly in combination with a high pressure liquid pump.

The fuel pump diaphragm 90 is biased by a diaphragm return spring 92 mounted against a fuel pump diaphragm washer 94. A flexible diaphragm wall 96 is controlled by another diaphragm washer 98 and a regulator spring 100. An adjusting screw 102 can vary the force of the regulator spring 100 and accordingly control the pumping displacement of the fuel pump diaphgram 90.

The fuel tank 38 is connected through a fuel line 36 to a check valve assembly 104 that can include a ball valve 106 appropriately seated and held in place by a valve intake spring 108. Both the float tank 4 and the fuel tank 38 are advantageously positioned above the pump to provide for a gravity feed.

In operation, the prime mover piston pump 20 can operate at a constant speed and provides the driving impulse forces through the hydraulic oil system. One or more diaphragm chambers with pumping diaphragms such as diaphragm 22 is capable of pumping the liquid concentrate solution to the heat exchanger 32.

As can be seen from FIG. 2, the actuator by-pass assembly 60 has its spool valve 62 in a spray position so that the by-pass conduit 63 is closed and the pumping diaphragm 22 and the differential area piston 84 are directly receiving the driving impulse forces. In this operational mode the cleaning gun 54 is being operated so that the four basic elements of cleaning, that is, soap, water, heat and friction (impact) are being utilized.

If the trigger of the operator controlled delivery valve 53 is released to stop the flow of heated liquid solution, the liquid pressure in the discharge line 24 will increase. This increased pressure will be transmitted through the static line 80 to one face of the actuator piston 72. As the pressure increases the spool valve 62 will be urged upward by the piston 72 against the pressure of the return spring 64. The actual amount of spring force on the return spring 64 can be controlled by the set screw 70.

The spool valve 62 first ports or closes the hydraulic line 82 and thereby stops the application of prime mover impulse forces to the differential area piston 84 so that the fuel pump is stopped. The relative position of the lands on the spool valve 62 are important since it is highly desirable to insure that the fuel pump 38 is not activated to deliver fuel to the burner in the case of leakage in the system. For this reason, the spool valve 62 is designed to provide lands positioned relative to the ports, as can be seen in FIG. 2, so that the port for the hydraulic pressure line 82 is first closed before the port of the by-pass conduit 63 is opened. If leaks occur in this system, for example, if the nozzle valve leaks and thereby permits a pressure drop to occur in the static line 80, the spool valve 62 could start to return as a result of the spring force of spring 64 and in effect start a throttling action with the by-pass conduit 63. This throttling action could build up pressure and create a liquid pumping action in the water diaphragm pump chamber through the diaphragm member 22.

The pressure drop will continue until the pumping action thus created will just equal the leak rate, thereby maintaining the fluid pressure. The pressure will be less than full by-pass pressure and higher than normal operating pressure, and is a result of the balance between the system fluid pressure acting on the actuator piston 72 and the force of the return spring 64. The spacing of the lands on a spool valve 62 will prevent any opening of the fuel pump hydraulic pressure line 82 to activate the fuel pump 38 in this mode of operation. Thus, this feature of the design will prevent inadvertent fuel delivery until the pressure drops sufficiently to close the by-pass conduit 63 completely. This will not occur until the operator controlled delivery valve 53 is fully opened to resume normal operation. A result of this feature is that burner operation will be controlled even though the fluid system may not be in good repair.

As the pressure builds up in the discharge line 24 as a result of the closing of the operator controlled delivery valve 53, the spool valve 62 will move further upward to open the by-pass conduit 63. With the by-pass conduit 63 open, the prime mover impulse forces from the piston 20 simply surges the hydraulic oil within the pump casing 56 and the hydraulic pressure is incapable of overcoming the spring forces against the liquid pump diaphragm 22.

As an additional feature of the present invention, the fuel pump 38 can be of an economical design as a result of the incorporation of means to reduce the prime mover impulse forces before application to the fuel pump 38. This is accomplished by the use of a differential area piston 84 that is mounted between the fuel hydraulic pressure line 82 and the sealed fuel actuating chamber 91. The actuating chamber 91 is filled with hydraulic oil and the piston return spring 86 biases the differential area piston 84 to seat within the actuating chamber 91. The differential area piston 84 comprises a reduced area (e.g., one quarter) compared to that of the area facing the sealed actuating chamber 91. As a result, the transmitted impulse forces are reduced on a ratio of 4 to 1 before they are applied to the fuel pump diaphragm 90.

The pumping chamber 93 of the fuel pump 38 includes not only the pumping diaphragm 90 but also a flexible diaphragm wall 96 which is controlled by a regulator spring 100. By appropriate adjustment of the adjustment screw 102, the displacement of the diaphragm wall 96 can be controlled and accordingly the displacement volume of the pumping chamber 93 is controlled to regulate the pressure and thereby the flow of fuel to the burner 44. The automatic fuel shut-off valve 42 is an additional safety feature to insure a definite stopping of fuel to the burner 44 and the prevention of any fuel delivery to the burner at abnormally low fuel pressure. Fuel pressure must be sufficient to insure atomizing of the fuel in the burner.

As a result of the features of the above described invention, a new improved high pressure washer system is provided whereby a hydraulic water pump and fuel interlock system insures both an economical and safe operation of the washer apparatus. In addition, relatively inexpensive fuel pump components can be utilized as a result of reducing the impulse forces necessary for pumping the liquid.

As can be readily appreciated various modifications can be accomplished within this scope of the present invention by persons skilled in the prior art and accordingly the parameters of the present invention should be determined solely from the following claims.

What is claimed is:

1. A combination liquid and fuel pumping apparatus for use in a pressurized hot fluid washer having an output conduit for applying the hot fluid, an operator controlled delivery valve, and heat exchanger means for heating the fluid including a fuel burner, comprising:

a liquid pump member adapted to being connected to the heat exchanger;

a fuel pump member adapted to being connected to the fuel burner;

a closed hydraulic prime mover means for applying a driving impulse force to both the liquid pump member and the fuel pump member including a by-pass conduit;

means for reducing the force of the driving impulse force before applying the force to the fuel pump member;

means for hydraulically sensing the liquid pressure downstream of the liquid pump member; and hydraulic means for opening the by-pass conduit to automatically stop the fuel pump member and the liquid pump member in response to a sensed predetermined liquid pressure.

2. The invention of claim 1 wherein the means for reducing the driving impulse force includes a differential area piston to proportionately reduce the transmitted driving impulse force.

3. A pressurized hot fluid washer apparatus comprising, a liquid pump member adapted to being connected to a source of liquid;

a fuel pump member adapted to being connected to a source of fuel;

a closed hydraulic pumping system for producing and applying a driving impulse force to both the liquid pump member and the fuel pump member, and a by-pass conduit for by-passing the liquid and fuel pump member;

a heat exchanger means connected to the liquid pump member for heating the fluid;

a fuel burner apparatus connected to the fuel pump for supplying heat to the heat exchanger means;

an output conduit connected to the heat exchanger means for delivering the heated fluid;

a control valve to regulate fluid flow through the output conduit;

means for hydraulically sensing the liquid pressure downstream of the liquid pump member;

hydraulic means for opening the by-pass conduit to automatically stop the fuel pump member and the liquid pump member in response to a sensed predetermined liquid pressure; and means for reducing the driving impulse force before applying the force to the fuel pump member.

4. A combination liquid and fuel pumping apparatus for use in a pressurized hot fluid washer having an output conduit for applying the hot fluid, an operator controlled delivery valve, and heat exchanger means for heating the fluid including a fuel burner, comprising:

a liquid pump member adapted to being connected to the heat exchanger;

a fuel pump member adapted to being connected to the fuel burner;

a closed hydraulic prime mover means for applying a driving impulse force to both the liquid pump member and the fuel pump member; and means for reducing the driving impulse force before applying the force to the fuel pump member.

5. In a pressurized hot fluid apparatus having an output conduit controlled by a delivery valve, heat exchanger means for heating the fluid, and means for providing fuel to the heat exchanger means, the improvement comprises:

means for pumping the fluid through the heat exchanger means including a closed hydraulic system having first prime mover pump means for creating impulse forces and a second pump member connected to the hydraulic system for transmitting the impulse forces to the fluid for pumping;

means for hydraulically sensing the fluid pressure in the output conduit;

hydraulic means for stopping the flow of fuel in response to a predetermined pressure level which indicates at least a below normal fluid flow through the heat exchanger such as when the delivery valve is closed including a by-pass conduit for by-passing the second pump member, and by-pass valve means for controlling the by-pass conduit including a housing member and a by-pass valve spool slidably mounted in the housing member.

6. The invention of claim 5 wherein the means for hydraulically sensing the fluid pressure includes a static line connected to the output side of the second pump member and also to one end of the valve spool.

7. The invention of claim 6 wherein the means for providing fuel to the heat exchanger includes a fuel pump member driven by the impulse forces of the hydraulic system and connected to the first prime mover pump means by a hydraulic pressure line connected to the by-pass valve means.

8. The invention of claim 7 wherein the by-pass valve spool includes a first and second land portion to respectively port the hydraulic pressure line to the fuel pump means and the by-pass conduit sequentially, in that order, whereby the fuel pump member will be stopped before the pumping of the fluid ceases.

9. The invention of claim 7 further including means for reducing the force of the prime mover pumping impulse forces before applying the impulse forces to the fuel pump member.

10. The invention of claim 9 wherein the means for reducing the fuel pumping impulse forces includes a fuel actuator piston connected between the fuel pump member and the hydraulic pressure line.

* * * * *